US012193561B2

(12) United States Patent
Crawford

(10) Patent No.: US 12,193,561 B2
(45) Date of Patent: Jan. 14, 2025

(54) PORTABLE MOBILE FOOD PREPARATION STATION

(71) Applicant: Christopher Jackson Crawford, Carlsbad, CA (US)

(72) Inventor: Christopher Jackson Crawford, Carlsbad, CA (US)

( * ) Notice: Subject to any disclaimer, the term of this patent is extended or adjusted under 35 U.S.C. 154(b) by 74 days.

(21) Appl. No.: 18/135,640

(22) Filed: Apr. 17, 2023

(65) Prior Publication Data

US 2023/0337811 A1 Oct. 26, 2023

Related U.S. Application Data

(60) Provisional application No. 63/333,484, filed on Apr. 21, 2022.

(51) Int. Cl.
*A45F 3/46* (2006.01)
*E03C 1/18* (2006.01)

(52) U.S. Cl.
CPC . *A45F 3/46* (2013.01); *E03C 1/18* (2013.01)

(58) Field of Classification Search
CPC ..... A45F 3/46; E03C 1/18
See application file for complete search history.

(56) References Cited

U.S. PATENT DOCUMENTS 3,915,529 A * 10/1975 Bernier ..... A47B 3/10 312/282
5,813,063 A * 9/1998 Watkins ..... E03C 1/18 4/628
6,427,259 B1 * 8/2002 Cawthon ..... E03C 1/326 4/654
9,791,200 B2 * 10/2017 Grepper ..... B01F 27/112
2013/0082051 A1 * 4/2013 Kaufmann ..... A45F 3/46 220/254.6
2023/0013573 A1 * 1/2023 McFadden ..... A47B 85/08

* cited by examiner

*Primary Examiner* — Tri M Mai
(74) *Attorney, Agent, or Firm* — Eric Hanscom

(57) ABSTRACT

A portable mobile food preparation station has a body with a fillable water tank, a pump, a battery, a hose, silverware, a cutting board, a sink, and a task light. Retractable handles allow for a stovetop and the sink to be mounted to the sides of the body, allowing for access to the cutting board and silverware while using the stovetop, sink, or both. The task light, made of high-brightness LEDs, is placed on the inside of a hinged lid, and facilitates use of the food preparation station in low light conditions.

4 Claims, 6 Drawing Sheets

PORTABLE MOBILE FOOD PREPARATION STATION

CROSS REFERENCE TO RELATED APPLICATIONS

This application claims priority back to U.S. Provisional No. 63/333,484, filed Apr. 21, 2021, the contents of which are incorporated by reference.

FIELD OF THE INVENTION

The present invention pertains generally to a portable food preparation station. The present invention is particularly, but not exclusively, useful as a food preparation tool for use in camping or other outdoor activities.

BACKGROUND OF THE INVENTION

Meal preparation in remote outdoor locations, such as during camping trips, is complicated by the need for potable water and the lack of adequate tools, such as a surface for preparing food, a place for washing dishes, and pressurized water for use in washing.

The response to these needs generally involves a diverse array of tools, including a table on which things such as a portable stove top, cutting board, cutlery and other silverware, and a pot or bucket for washing must be arranged. In many instances, these things must be used one at a time, and in other cases, some but not all can be used at once, due to space constraints. Some conveniences, such as pressurized water, are often simply omitted.

In view of the above, it would be advantageous to provide an apparatus that facilitates the various tasks necessary for cooking in a remote location, while minimizing space requirements.

SUMMARY OF THE INVENTION

Disclosed is a portable mobile food preparation station, having a body with a tillable water tank, pump, battery, hose, silverware, cutting board, sink, and task light. Retractable handles allow for a stovetop and the sink to be mounted to the sides of the body, allowing for access to the cutting board and silverware while using the stovetop, sink, or both. The task light, made of high-brightness LEDs in a preferred embodiment, is placed on the inside of a hinged lid, and facilitates use of the food preparation station in low light conditions.

When the portable mobile food preparation station is not in use, the lid is secured in a closed position with one or more latches. A pair of wheels on one end of the station and an extendable handle on the opposite end facilitate transport of the station on the ground, such as between a vehicle and a campsite, or between a vehicle and a storage location.

To use the portable mobile food preparation station, the latches are disengaged and the lid raised. The extendable handle is extended, and a mount for a stovetop is placed on it, and a stovetop is placed on the mount. A second extendable handle, opposite the first, is extended, and the sink is removed from the station body and mounted on it. The cutting board is then positioned as desired on the body, and, if needed, the task light is turned on. The pump is also turned on when pressurized water is needed, and the water is accessed through the hose. A nozzle at the end of the hose is engageable to spray, water as needed.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION

Figure 1:
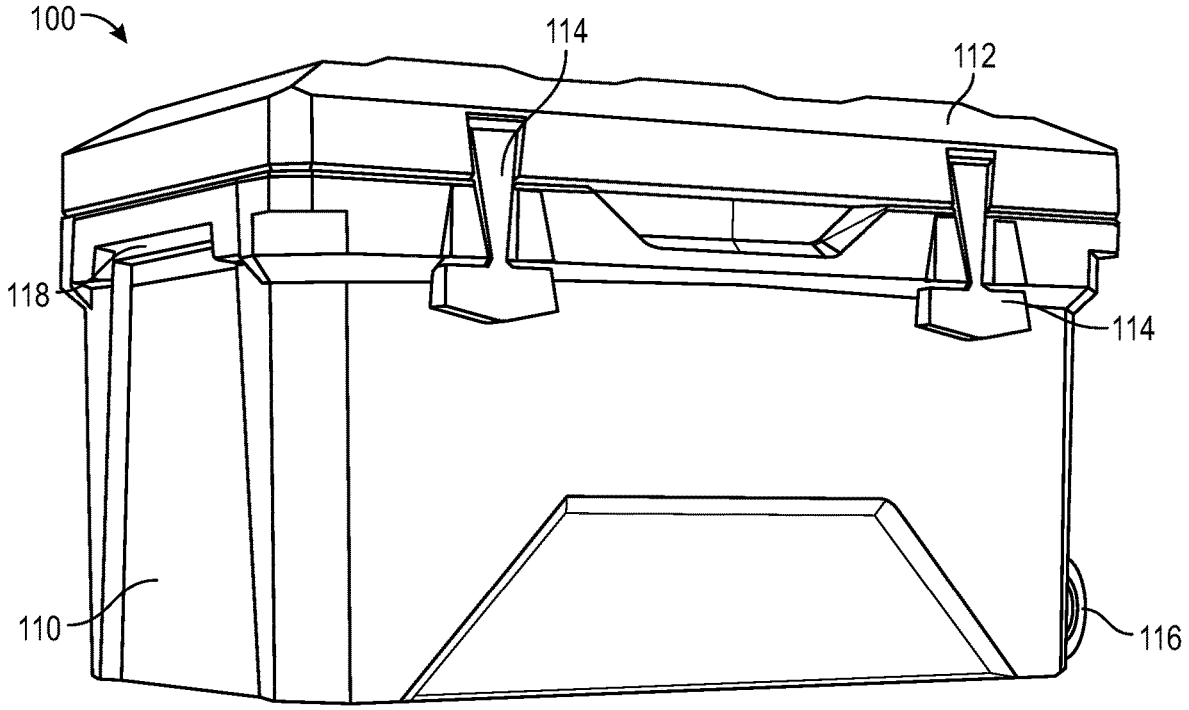
FIG. 1 is a perspective view of a preferred embodiment of a portable mobile food preparation station in a closed configuration.

Referring initially to FIG. 1, a preferred embodiment of a portable mobile food preparation station is illustrated in a closed configuration and generally designated 100. Station 100 has a box 110 with a hinged lid 112 secured to box 110 in a closed configuration with two latches 114. Wheels 116 and an extendable handle 118 opposite wheels 116 facilitate pedestrian transport of station 100, e.g., to and from a vehicle for use or for storage.

Figure 2:
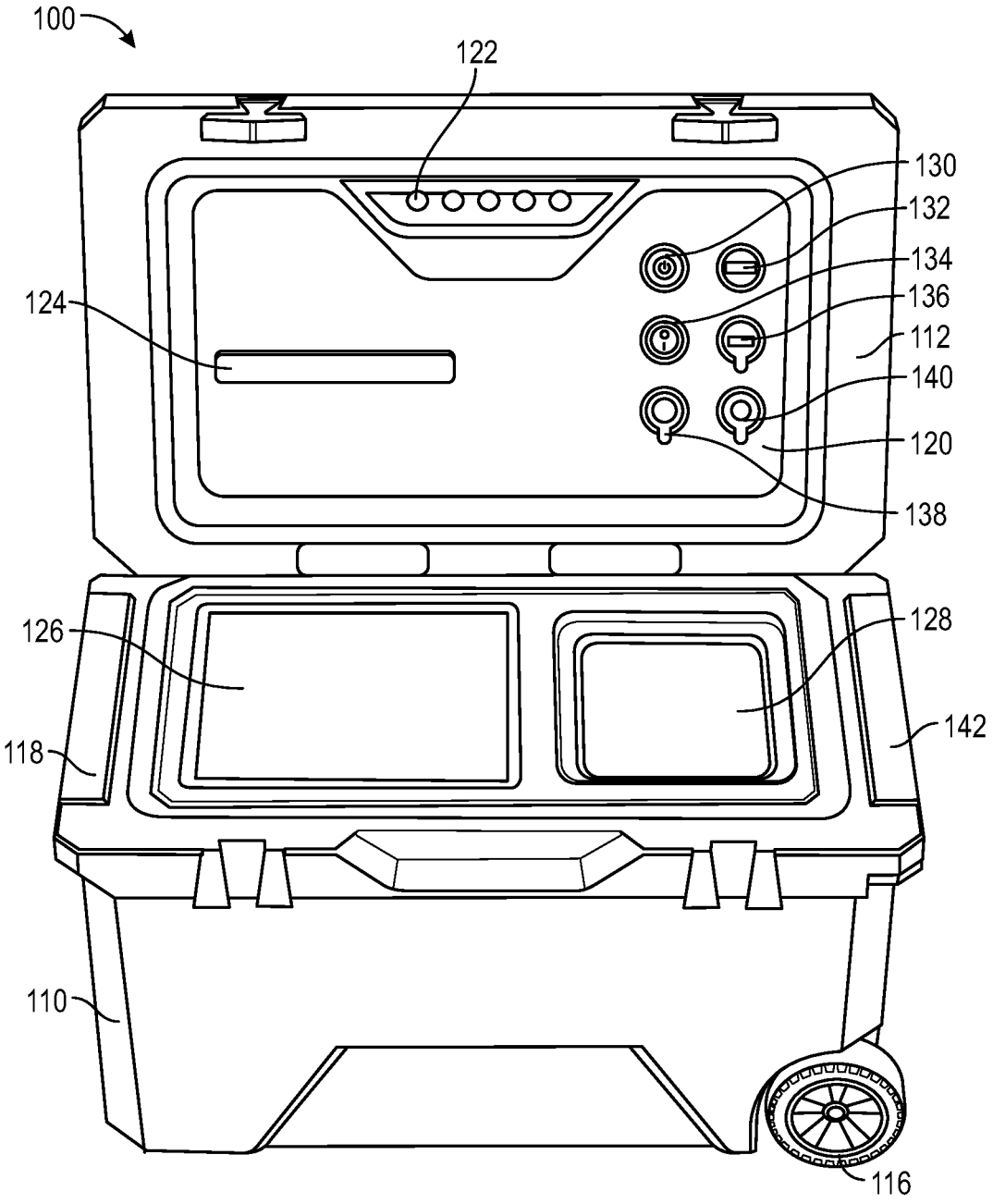
FIG. 2 is a perspective view of a preferred embodiment of a portable mobile food preparation station in a partially open configuration, illustrating the control panel, lights, cutting board, and collapsible sink.

Referring now to FIG. 2, portable mobile food preparation station 100 is illustrated in an initial open configuration, showing a control panel 120, task light 122, and silverware magnet 124 on the inside surface of lid 112, as well as a cutting board 126 and collapsible sink 128 inside box 110.

In a preferred embodiment, control panel 120 has a power button 130 for turning on and off water pump 162 (see FIG. 6), a temperature meter connector 132, an on/off button 134 for task light 122, a voltmeter connector 136, a USB connector 138, and a 12V marine battery connector 140.

A preferred embodiment of task light 122 is made of a plurality of high brightness LEDs, providing light for working with the station 100 while minimizing power consumption.

Collapsible sink 128 is removable in a preferred embodiment, allowing it to be mounted on extendable handle 142 in order to increase the working space available in box 110.

Figure 3:
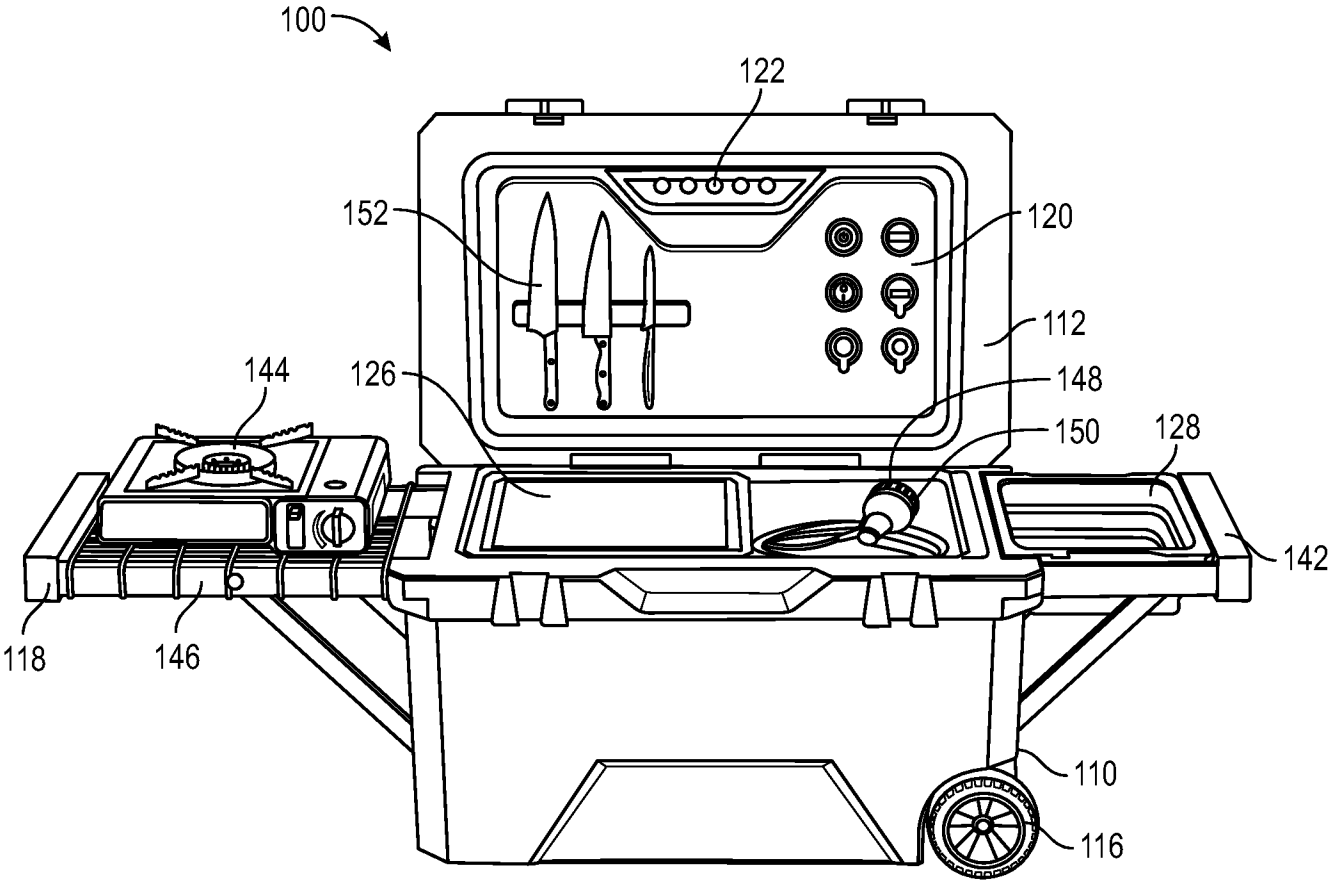
FIG. 3 is a front perspective view of a preferred embodiment of a portable mobile food preparation station in an open configuration, illustrating the station in use with a portable burner.

Referring now to FIG. 3, portable mobile food preparation station 100 is illustrated in a fully open configuration with handles 118 and 142 extended. In the fully open configuration, a stove holder 146 mounted on extendable handle 118 and a stovetop 144 or burner facilitates cooking. Collapsible sink 128 is mounted on extendable handle 142, revealing a hose 148 and nozzle 150 stored in box 110. Once mounted on extendable handle 142, collapsible sink 128 is able to extend further downward providing a greater sink volume for washing. Exemplary silverware 152, illustrated in the form of cutlery, is mounted on silverware magnet 124 on the inside surface of lid 112 in order to facilitate access during cooking.

Figure 4:
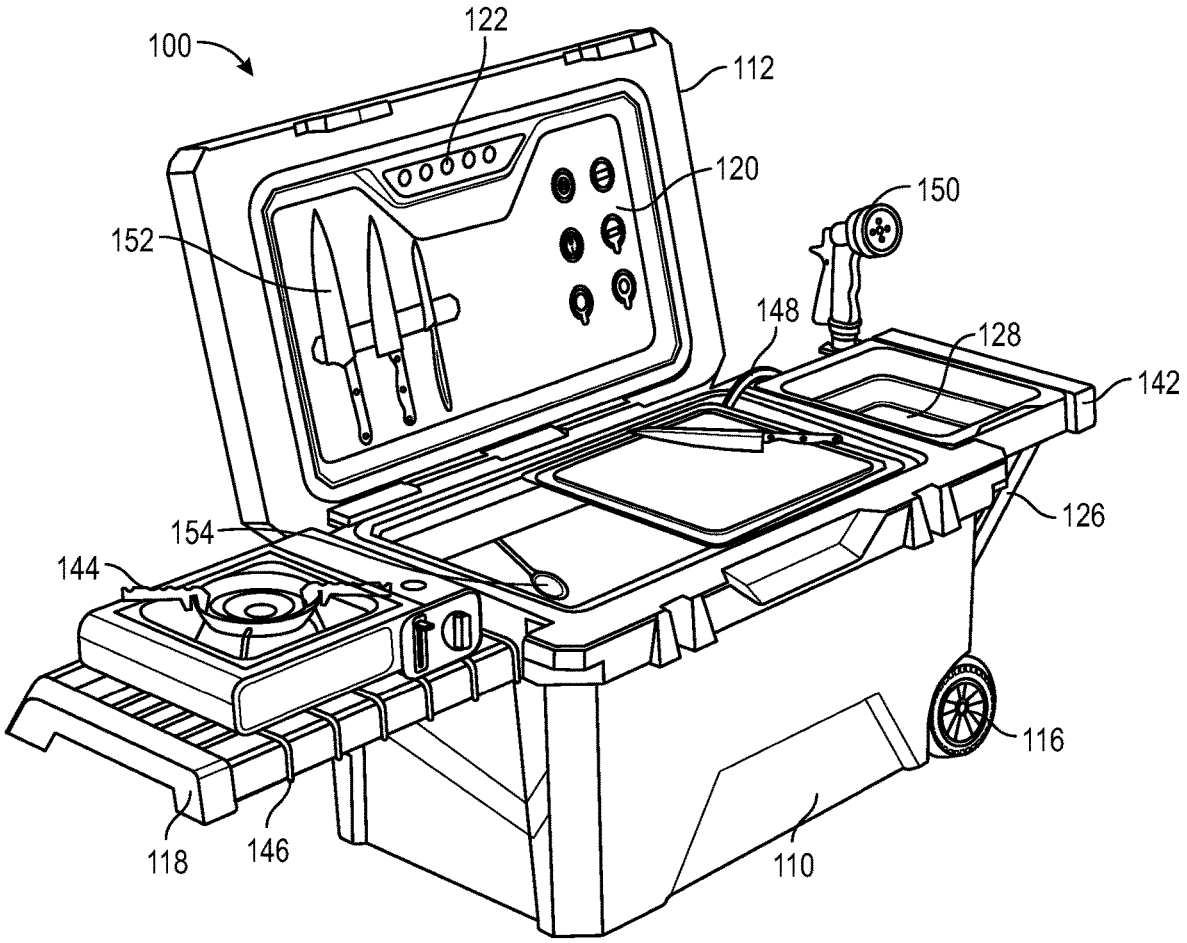
FIG. 4 is a perspective view of a preferred embodiment of a portable mobile food preparation station in an open configuration with the collapsible sink moved to the right handle and the sprayer mounted proximate the sink.

Referring now to FIG. 4, portable mobile food preparation station 100 in the fully open configuration is illustrated in an exemplary use case. Nozzle 150 is mounted on handle 142 behind collapsible sink 128, for use with collapsible sink 128. Cutting board 126 has been moved to the right, above the hose storage compartment 158 (see FIG. 6), into the location in which collapsible sink 128 is normally placed when station 100 is not in use and in its closed configuration. This position of cutting board 126 reveals the silverware storage compartment 154, located under cutting board 126 when station 100 is not in use, allowing for access to silverware stored therein. In this layout of the fully open configuration, food preparation facilitated, as it enables cutting or other activity on cutting board 126 with access to silverware in storage compartment 154, while cooking on stovetop 144 and washing with collapsible sink 128 in conjunction with hose 148 and nozzle 150 is easily performed.

Figure 5:
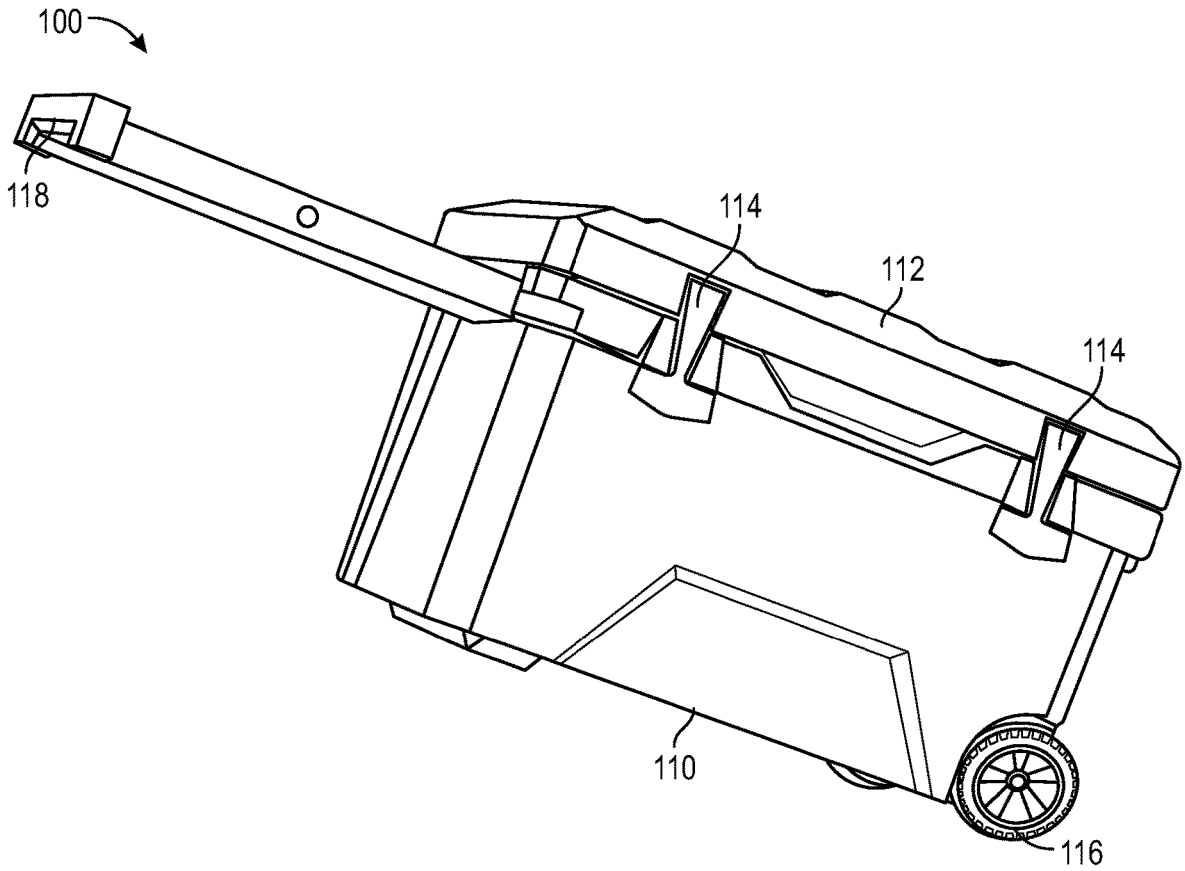
FIG. 5 is a front perspective view of a preferred embodiment of a portable mobile food preparation station in the closed configuration with the left handle extended to facilitate transport.

Referring now to FIG. 5, portable mobile food preparation station 100 is illustrated in its closed configuration with extendable handle 118 extended to simplify transport. For terrestrial transport, station 100 is placed in its closed configuration with lid 112 down and secured against box 110 with latches 114. Extendable handle 118 is extended, and station 100 is raised at extendable handle 118 so that only wheels 116 touch the ground. Thus station 100 can easily be pulled to its destination. When arriving at a vehicle or at a place of storage, extendable handle 118 is replaced into box 110 as illustrated by FIG. 1, in order to minimize space requirements for vehicle transport and storage.

Figure 6:
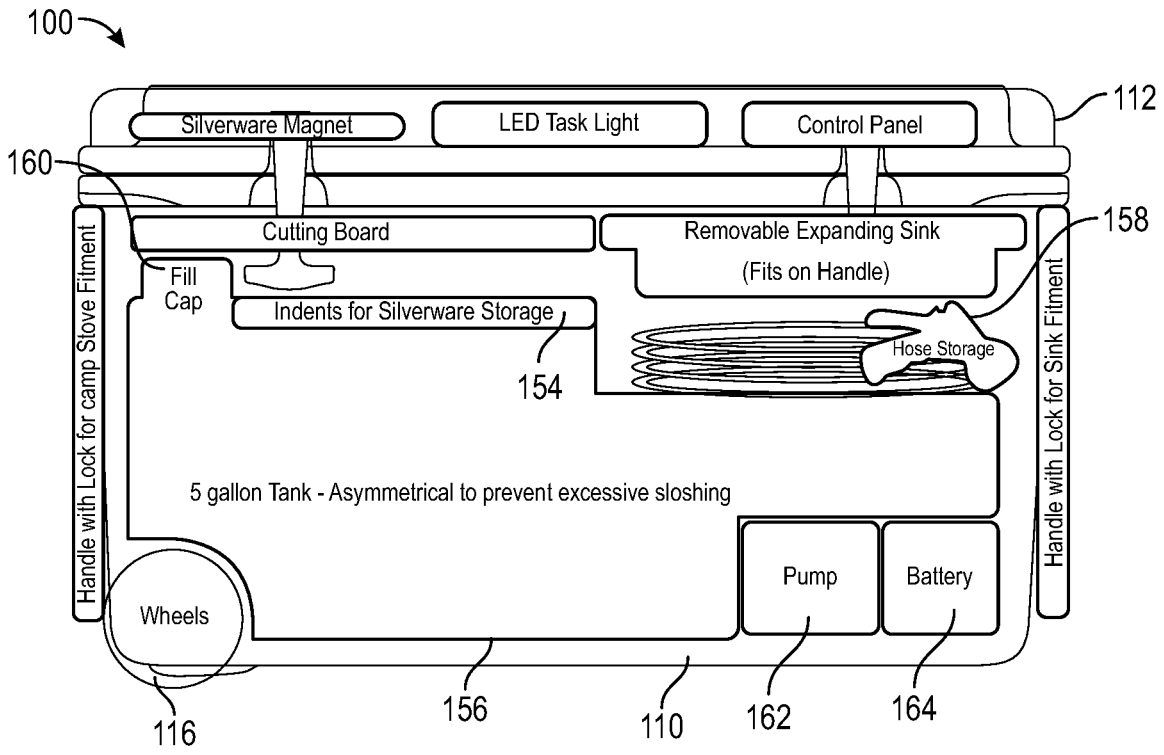
FIG. 6 is a diagram illustrating the layout of the various parts of a preferred embodiment of a portable mobile food preparation station.

Referring now to FIG. 6, the layout of features of a preferred embodiment of portable mobile food preparation station 100 is illustrated. Box 110 of station 100 contains a five-gallon tank 156 located below silverware storage compartment 154 and hose storage compartment 158. A fill cap 160 beside silverware storage compartment 154 and cutting board 126 allows for tank 156 to be filled with water. A pump 162 provides water pressure to hose 148, and battery 164 provides electrical power for the operation of pump 162 as well as other features of station 100, such as task light 122 and control panel 120. Battery 164 is chargeable by connecting station 100 to an external power source, e.g., via marine battery connector 140 or USS connector 138 (see FIG. 2); marine battery connector 140 also facilitates continued use of station 100 when battery 164 is in low charge conditions.

When pump 162 is active, water pressure is provided to hose 148, and water is released when nozzle 150 is engaged.

While there have been shown what are presently considered to be preferred embodiments of the present invention, it will be apparent to those skilled in the art that various changes and modifications can be made herein without departing from the scope and spirit of the invention.

What I claim is:

1. A device comprising a portable, mobile food preparation station consisting of:

a body, wherein the body has a fillable water tank, wherein the body has two or more retractable handles which allow for a stovetop and a sink to be mounted within the body a pump, wherein the pump provides pressurized water to the sink through a hose, where the hose at a terminal end has a nozzle, wherein the nozzle allows for deliver or water at different arrays an assortment of silverware, a cutting board, at least one of said two or more extendable handles is nestled within the body, and is extended out when the device is to be moved, a hinged lid, wherein the hinged lid is hingeably attached to the body, where one or more latches secure the hinged lid to the body when the device is not in use, wherein the hinged lid additionally comprises a control panel, wherein the control panel comprises two or more on-off buttons and a task light, wherein the task light is made of high-brightness LEDs, and wherein the task light is located on an inside surface of the hinged lid, where the task light is turned on an off by one of the two or more on-off buttons on the hinged lid, a battery, where the battery supplies a power to the pump and to the task light, where the pump is turned on an off by one of the two or more on-off buttons on the hinged lid.

2. The device of claim 1, where the control panel additionally comprises a temperature meter connect, a volumeter connector, a USC connector and a 12V marine battery connector.

3. The device of claim 2, where the sink is a collapsible sink.

4. The device of claim 3, where the assortment of silverware is secured by a magnet on the inside surface of the hinged lid.

* * * * *